United States Patent [19]

Sanbayashi et al.

[11] Patent Number: 4,573,787

[45] Date of Patent: Mar. 4, 1986

[54] EXPOSURE LAMP CONTROL FOR IMAGE FORMING APPARATUS

[75] Inventors: Takeshi Sanbayashi, Tokyo; Hideshi Oushiden, Kawasaki, both of Japan

[73] Assignee: Kabushiki Kaisha Toshiba, Kawasaki, Japan

[21] Appl. No.: 628,983

[22] Filed: Jul. 9, 1984

[30] Foreign Application Priority Data

Jul. 11, 1983 [JP] Japan ..... 58-125945

[51] Int. Cl.[4] ..... G03G 15/00

[52] U.S. Cl. ..... 355/14 E; 355/55; 355/69

[58] Field of Search ..... 355/14 E, 3 R, 14 R, 355/55, 56, 67, 68, 69

[56] References Cited

U.S. PATENT DOCUMENTS 3,926,518 12/1975 Berry et al. ..... 355/14 E X
4,200,391 4/1980 Sakamoto et al. ..... 355/14 E
4,354,758 10/1982 Futaki ..... 355/68 X
4,436,410 3/1984 Komiya ..... 355/69 X
4,460,270 7/1984 Watai et al. ..... 355/14 E
4,474,460 10/1984 Suzuki ..... 355/69 X

*Primary Examiner*—A. C. Prescott
*Attorney, Agent, or Firm*—Cushman, Darby & Cushman

[57] ABSTRACT

In a copy machine with a variable copy magnification, light reflected from a document, which is exposed by an exposure lamp, is led to a photosensitive drum to form thereon a copy image of a predetermined size and also led to a photo detecting circuit to detect a density of the document and to control an amount of exposure. An exposure control circuit of the copy machine comprises a magnification setter for generating a magnification signal dependent on a magnification as selected, a control signal generating circuit for generating a control signal according to the magnification signal and the output signal from the photo detecting circuit and a power source circuit for applying a power voltage to the exposure lamp according to the control signal.

8 Claims, 26 Drawing Figures

EXPOSURE LAMP CONTROL FOR IMAGE FORMING APPARATUS

BACKGROUND OF THE INVENTION

The present invention relates to an image forming apparatus such as a copy machine with a variable copy magnification.

In a general copy machine, a moving exposure lamp optically scans a document on a document table. A rotating photosensitive drum is subjected to a slit exposure by the reflecting light from the document. Then, the picture on the document is imaged onto the photosensitive drum. The image formed on the drum is transferred to a copy paper. To change a copy magnification, it is necessary to change the size of the image on the drum. Generally, the density of a copy image on the copy paper is proportional to the density of the image on the drum. The density of the copy image is expressed by a ratio of the amount of exposure light emitted from the exposure lamp to the size of the image on the drum. This indicates that, with a fixed amount of exposure light, the copy image is darker with the increase of the copy magnification, and vice versa. Thus, the density of the image copied changes with the setting or selecting of the copy magnification. For fixing the density of the copy image independent of the copy magnification, it is necessary to control the amount of exposure light according to the copy magnification, allowing for the above relationship between the copy density and the copy magnification.

The amount of the exposure light emitted from an exposure lamp is generally controlled by a lamp regulator. The lamp regulator includes a control signal generator for generating a control signal upon the detection of reflected light from a document, and a detector for detecting a voltage applied to the exposure lamp. A difference between the control signal and the applied voltage is used for controlling the voltage applied to the exposure lamp. Accordingly, the density of each document defines the reference signal. In this way, the amount of exposure light from the exposure lamp is automatically controlled.

The control signal is obtained, for example, by amplifying the output signal from a photo sensor element by a differential amplifier. To make the control signal also dependent on the copy magnification, in such a case, it is sufficient to change the amplification factor of the differential amplifier. The amplification factor of the differential amplifier is proportional to a feedback resistance. This implies that, to change the amplification factor, a number of feedback paths with different resistances are provided, and one of the feedback paths is selected according to the copy magnification. This approach effectively works for a lesser number of selected copy magnifications. However, it fails to cope well in the case when the copy magnification must be continuously changed, because of its inevitable size increase. In the conventional copy machine, only a few control signals are available for controlling the exposure light even if the copy magnification may be continuously changed. Hence, these signals cannot correctly control the exposure light for every copy magnification selected.

SUMMARY OF THE INVENTION

Accordingly, an object of the present invention is to provide an image forming apparatus which always keeps an optimum exposure of a document against a variety of image magnifications.

According to the present invention, there is provided an image forming apparatus comprising: a magnification setting means for setting a copy magnification at a desired value to produce a magnification signal; an exposure means for illuminating a document, and leading light reflected from the document to a photosensitive member to form on the photosensitive member an image of the document of a size as determined according to a copy magnification; a photo detecting means for detecting the reflected light from the document, exposed to the light from the exposure means, to detect the density of the document; a reference signal generating means for generating a reference signal according to the magnification signal and the output signal from the photo detecting means; and a power source means for supplying power voltage dependent on the reference signal to the exposure means.

With such an arrangement, the exposure control is performed according to a magnification signal for each magnification. Therefore, an optimum light exposure of the document is ensured for any magnification.

DETAILED DESCRIPTION OF THE PREFERRED EMBODIMENTS

Figure 1:
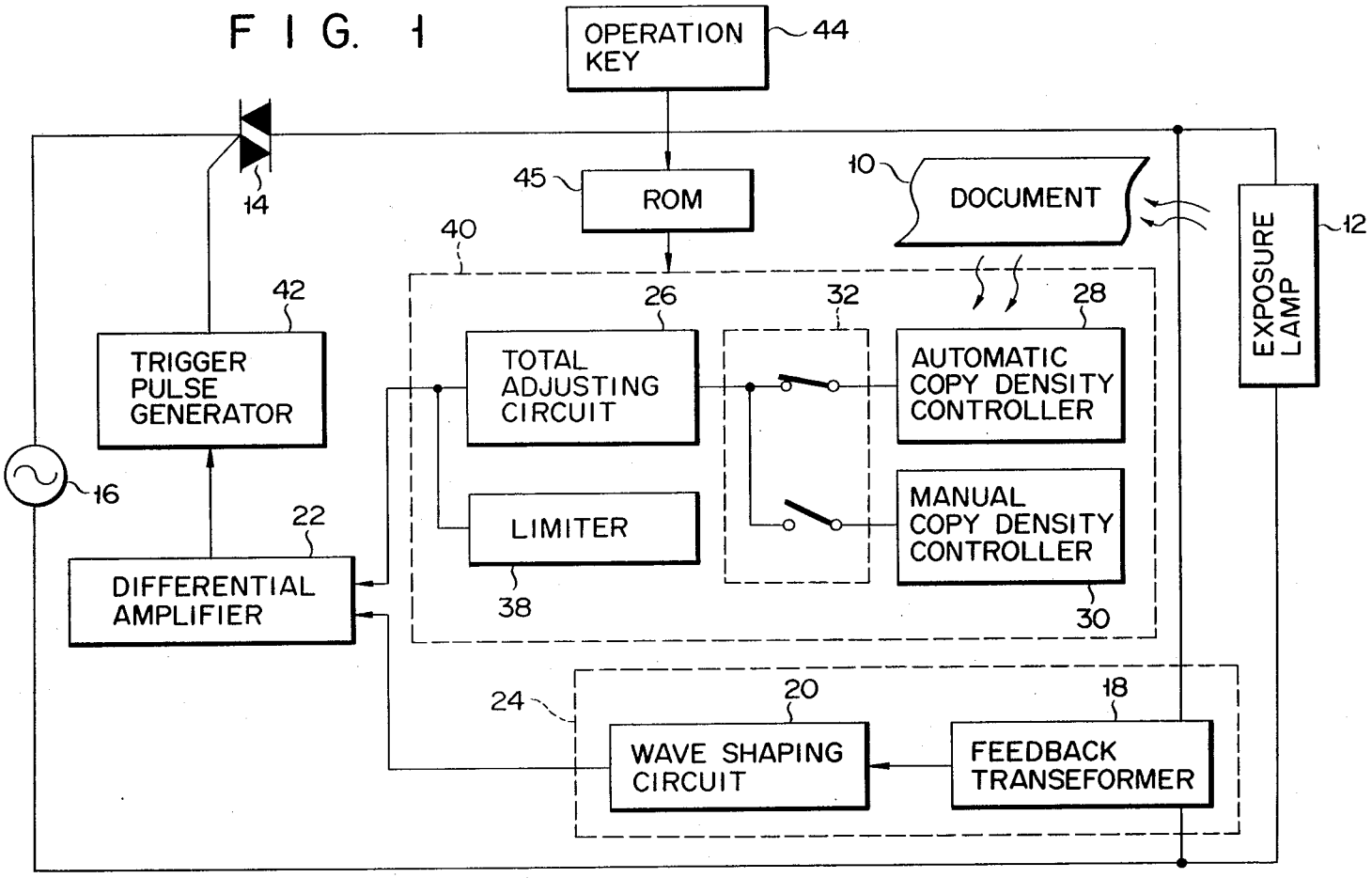
FIG. 1 is a block diagram generally illustrating an embodiment of an image forming apparatus according to the present invention.

A general description of a copy machine as an image forming apparatus according to the present invention will first be given referring to the block diagram of FIG. 1. An exposure lamp 12 for illuminating a document 10 is connected through a Triac 14, as a power regulating element, to an AC power source 16. The exposure lamp 12 entirely illuminates the document 10 while moving along the document 10 by means of a drive mechanism (not shown). A feedback transformer 18 is connected in parallel with the exposure lamp 12. The feedback transformer 18 detects voltage applied to the exposure lamp 12 when the Triac 14 is in an ON state, and applies the detected voltage to a wave shaping circuit 20. The wave shaping circuit 20 wave shapes the input voltage and applies an effective value of the voltage across the exposure lamp 12 to the first input terminal of a differential amplifier 22. The feedback transformer 18 and the wave shaping circuit 20 cooperatively form a voltage detector 24 for generating a voltage corresponding to the voltage applied to the exposure lamp 12.

The output of total adjusting circuit 26 is connected to the second input terminal of the differential amplifier 22. Connected to the total adjusting circuit 26 via a selector 32 are both the output of an automatic copy density controller 28 for producing a signal corresponding to the reflected light from the document 10 exposured to the light from the exposure lamp 12, and the output of a manual copy density controller 30 for producing a predetermined signal. The output signal of the automatic copy density controller 28 also depends on a copy magnification. The selector 32, externally controlled, is comprised of two switches respectively connected to the automatic copy density controller 28 and the manual copy density controller 30. The selector 32 is operated according to a mode of the copy density control. In an automatic control mode, the selector 32 selects the output signal of the automatic copy density controller 28. In a manual control mode, it selects the output signal of the manual copy density controller 30. The total adjusting circuit 26 produces a signal also depending on a copy magnification. A limiter 38 is also connected to the output terminal of the total adjusting circuit 26. The output level of the total adjusting circuit 26 corresponds to a density of the document 10. Therefore, if the document density becomes low, the output level of the total adjusting circuit 26 becomes high. The limitter 38 prevents that the output of the total adjusting circuit 26 becomes larger than the rating of the exposure lamp 12. The total adjusting circuit 26, the automatic copy density controller 28, the manual copy density controller 30, the selector 32 and the limiter 38 cooperatively form a control signal generator 40 for generating a control signal for the exposure lamp 12. Thus, the control signal of the control signal generator 40 reflects a copy magnification.

A difference between the output from the control signal generator 40 and the output from the voltage detector 24 is supplied to a trigger pulse generator 42. The trigger pulse generator 42 applies a trigger pulse to the gate of the Triac 14 at the timing as determined by the input signal applied thereto, thereby to control a conduction angle of the Triac 14. Accordingly, the amount of light emitted from the exposure lamp 12 depends on a copy magnification.

As seen from the foregoing, in the image forming apparatus under discussion, the voltage applied to the exposure lamp 12 is controlled by the output of the control signal generator 40. Therefore, the voltage applied to the exposure lamp 12 can be kept at a fixed value against a variation of the AC power source 16. An operation key 44 is used for inputting various control signals including the magnification control signal. The magnification data are read out from a ROM 45 according to the magnification control signal.

Figure 2:
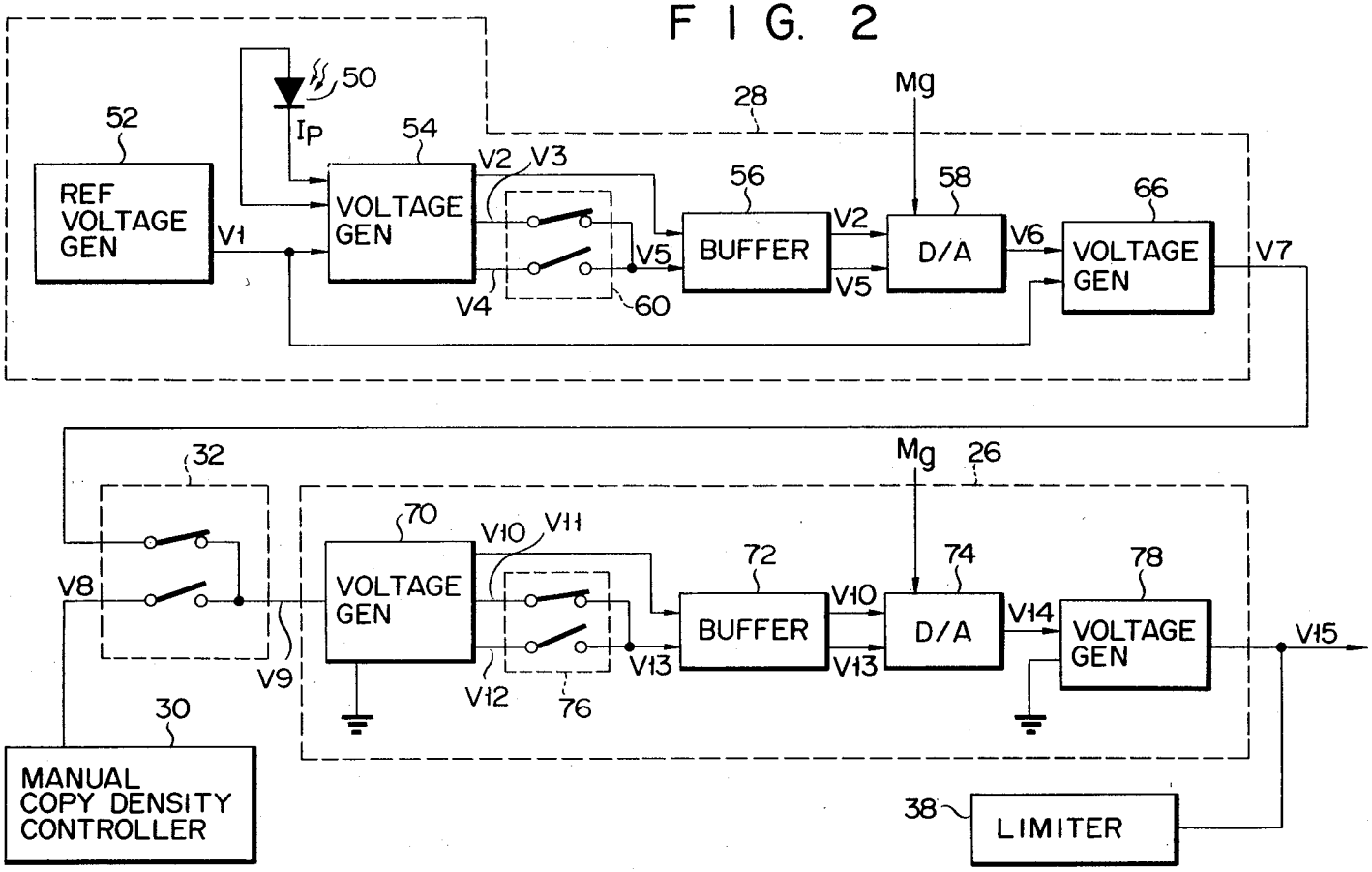
FIG. 2 is a block diagram illustrating in detail a control signal generator used in the embodiment in FIG. 1.

A more detailed arrangement of the control signal generator 40 will be described referring to FIG. 2. The light reflected from the document 10 is input to a photo diode 50 which feeds a photo current Ip to a voltage generator 54. In order to always optimize the density of a copy image independent of the density of the document 10 in an automatic copy density control mode, the reference voltage generator 52 reference voltage V1 applies to the voltage generator 54. Responsive to the reference voltage V1 and the photo current Ip, the voltage generator 54 produces the following three voltage signals V2, V3 and V4:

$$V2 = V1 - C1 \cdot Ip \quad (1)$$

$$V3 = V1 - C2 \cdot Ip \quad (2)$$

$$V4 = V1 - C3 \cdot Ip \quad (3)$$

where C1, C2 and C3 are coefficients which can be set for each apparatus differently if necessary, and $C2 < C1 < C3$. Accordingly, if V1 and Ip are set at constant values, then $V4 < V2 < V3$.

Of those three output voltages from the voltage generator 54, the voltage V2 is supplied through a buffer 56 to a D/A converter 58. Either of the remaining voltages V3 and V4 is selected by a selector 60, and the selected one is supplied through the buffer 56 to the D/A converter 58. The selector 60, like the selector 32, contains two switches either of which is operated by a related external control signal, more exactly, a 1-bit signal for directing one of 2 modes of copy magnification, enlargement (including normal) and reduction. In an enlargement (normal) mode, the selector 60 selects the voltage V3 and produces it as voltage V5. In a reduction mode, it selects the voltage V4 and produces it as the voltage V5. The buffer 56 transfers the received voltages V2 and V5 to the D/A converter 58.

The D/A converter 58 is also supplied with a magnification signal Mg representing a copy magnification as set by the operation key 44 and read out from the ROM 45. Under the control of the magnification signal Mg, the D/A converter 58 voltage divides the difference between the voltages V2 and V5 according to the following equation (4):

$$V6 = V2 + Mg \times (V5 - V2) \quad (4)$$

The divided voltage V6 is then supplied to a voltage generator 66. In this relation, since V5 differs depending on the enlargement or the reduction, Mg represents the difference (absolute value) between the selected magnification (%) and the equal magnification (100%).

As seen from the above, the D/A converter 58 produces a signal V6 proportional to the magnification signal Mg derived from the ROM 45. This signal V6 provides an exact exposure control according to the selected magnification. In an enlargement mode, $V5 = V4$; in a reduction mode, $V5 = V3$. As recalled, $V4 < V2 < V3$. Then, in the enalrgement or reduction mode, V6 takes a value lesser or greater than V2 in the enlargement or reduction mode.

The voltage generator 66 is also supplied with the reference voltage signal V1. The voltage generator 66 uses the reference signal V1 and the signal V6 to produce the following signal V7 as given by an equation (5), and produces it as the output of automatic copy density controller 28:

$$V7 = V1 + C4 \times (V6 - V1) \quad (5)$$

where C4 is the coefficient. Substituting the equations (1)-(4) into the equation (5):

$$V7 = V1 - \{C1 - (C1 - C2)Mg\}C4Ip \quad (6)$$

(for the enlargement and normal modes)

$$V7 = V1 - \{C1 + (C3 - C1)Mg\}C4Ip \quad (7)$$

(for the reduction mode)

The manual copy density controller 30 produces a predetermined voltage signal V8, which is formed by properly dividing the power source voltage through a lever action of the operation lever (not shown). The selector 32 selects either of the voltage signals V7 and V8, and the selected one is transferred as a voltage signal V9 to a voltage generator 70. The voltage generator 70, like the voltage generator 54, produces three voltage signals V10, V11 and V12 based on the voltage V9 and as given by the following equations:

$$V10 = C5 \times V9 \quad (8)$$

$$V11 = C6 \times V9 \quad (9)$$

$$V12 = C7 \times V9 \quad (10)$$

where C5, C6 and C7 are the coefficients, respectively, and C7<C5<C6. If V9 is constant, V12<V10<V11.

Of the three output voltages of the voltage generator 70, the voltage V10 is supplied through a buffer 72 to a D/A converter 74. The voltages V11 and V12 are applied to a D/A converter 74 through a selector 76. The selector 76 is used for selecting either of the voltages V11 and V12. The selector 76 contains two switches which are selectively operated by external 1-bit control signal for directing enlargement (normal) and reduction modes. The selector 76 produces a voltage signal V11 in the enlargement (normal) mode, and produces a voltage signal V12 in the reduction mode. The output voltage of V11 or V12 is denoted as V13 in the figure. The buffer 72 having a normal buffering function transfers the voltages V10 and V13 to the D/A converter 74.

The D/A converter 74 further receives the magnification signal Mg representing a selected magnification sent from the ROM 45. According to this signal Mg, the D/A converter 74, like the D/A converter 58, divides a difference between the voltages V10 and V13 as given by the following equation (11) and transfers it to a voltage generator 78:

$$V14 = V10 + Mg(V13 - V10) \quad (11)$$

Also in this case, V13=V11 in the enlargement (normal) mode, and V13=V12 in the reduction mode. Since V12<V10<V11, the voltage V14 is greater or lesser than V10 in the enlargement mode or the reduction mode. In this way, the D/A converter 74 supplies to a voltage generator 78 the voltage signal V14 dependent on the magnification signal Mg. The voltage generator 78 generates a voltage signal V15 dependent on the input voltage signal V14 and as given by the following equation (12), and supplies it to the total adjusting circuit 26:

$$V15 = C8 \times V14 \quad (12)$$

where C8 is the coefficient. Substituting the equations (8)–(11) into the equation (12):

$$V15 = C8\ \{C5 + (C6 - C5)Mg\}V9 \quad (13)$$

(for the enlargement mode)

$$V15 = C8\ \{C5 - (C5 - C7)Mg\}V9 \quad (14)$$

(for the reduction mode)

As seen from the foregoing description, an amount of the exposure light of the exposure lamp can easily be adjusted depending on a copy magnification selected. Further, by finely adjusting the coefficients for each apparatus, the difference in an amount of the exposure light between copy machines can be reduced.

A detailed configuration of the control signal generator 40 will be described referring to FIG. 3, which depicts the scheme of FIG. 2 in the form of a circuit diagram. For simplicity of illustration, like reference numerals are used for designating like or equivalent portions. The reference voltage generator 52 is comprised of a differential amplifier, connected at the noninverting input terminal to the DC power source VB through a resistor 108 and at the inverting input terminal to the output terminal cathode of the photo diode 50. The voltage generator 54 is comprised of a differential amplifier 100 and potentiometers 102, 104, a resistor 106 connected in series between the output terminal and the inverting input terminal thereof. The photo diode 50 is respectively connected at the cathode and the anode to the noninverting input terminal and the inverting input terminal of the differential amplifier 100. The photo current Ip is derived from the anode of the photo diode 50. The voltage signal V2 is derived from the junction between the potentiometers 102 and 104. The voltage signals V4 and V3 are derived from the voltage dividing point of the potentiometers 102 and 104. The potentiometers 102 and 104 are for adjusting the reference voltages V3 and V4 of the D/A converter 58. The potentiometers 102 and 104 are adjusted in the factory before shipment to reduce the difference in the reference voltages V3 and V4 between copy machines.

The buffer 56 is comprised of a couple of differential amplifiers 110 and 112 of which the output terminals are connected to the inverting input terminals thereof. The voltage signals V2 and V5 (selected one of V3 and V4) are supplied to the noninverting input terminals of the differential amplifiers 110 and 112.

The D/A converter 58 is comprised of an R - 2R ladder resistor network and selectors. The ladder resistor network includes five R resistors (of resistance R) r1–r5 connected in series, and seven 2R resistors (of resistance 2R) 2r1–2r7 respectively connected at their ends to junction points of the R resistors. The output voltage V2 of the differential amplifier 110 is supplied to the resistor 2r1. The voltage signal V2 or V5 which is selected by selectors is applied to the resistors 2r2–2r7. Three selectors are formed of one semiconductor switch IC (TC 4053BP Toshiba). The selectors coupled with the resistor 2r2–2r4 are formed of a semiconductor switch IC 111, while the selectors connected to the resistors 2r5–2r7 are formed of another semiconductor switch IC 113. Those selectors are under the control of a magnification signal from the ROM 45. A voltage at the junction point between the resistors r5 and 2r7 is applied as the voltage V6 to the voltage generator 66.

The voltage generator 66 is comprised of a differential amplifier 114, a variable resistor 116 connected between the output terminal and the inverting input terminal of the differential amplifier 114, and a resistor 118 connected between the inverting input terminal of the differential amplifier 114 and the output terminal of the voltage generator 52. The output voltage V6 of the D/A converter 58 is connected to the noninverting input terminal of the differential amplifier 114. The variable resistor 116 is used for reducing the difference in the voltage V7 between the copy machines in the factory before shipment. The output of the differential amplifier 114 is produced as the output signal V7 of the automatic copy density controller 28 and is supplied to the first input terminal of the selector 32.

The manual copy density controller 30 is comprised of three resistors 120, 122 and 124 connected in series between the noninverting input terminal of the voltage generator 52 and ground, a potentiometer 126 connected across the resistor 122, and a differential amplifier 128 of which the output terminal and the inverting input terminal are interconnected. The potentiometer 126 is coupled with a slide lever (not shown) for manual copy density controller provided in the upper surface of the apparatus. For setting a desired voltage dividing ratio, the slide lever is operated. The voltage dividing point of the potentiometer 126 is connected to the noninverting input terminal of the differential amplifier 128. The output of the differential amplifier 128 is produced as the output signal V8 of the manual copy density controller 30.

The voltage generator 70 is comprised of potentiometers 130 and 132 connected in series between the output terminal of the selector 32 and ground. A voltage signal V10 is derived from the junction point of the potentiometers 130 and 132, and voltage signals V11 and V12 are derived from voltage dividing points of the potentiometers 130 and 132. The potentiometers 130 and 132 are for adjusting the reference voltages V11 and V12 for the D/A converter 74. The difference in those reference voltages between the copy machines are reduced using the potentiometers 130 and 132 before delivery of the copy machines from the factory. Those selectors 60, 32 and 76 are formed of a single semiconductor switch IC (TC 4053BP as mentioned above).

The buffer 72 is comprised of a couple of differential amplifiers 134 and 136 which produce voltage signals V13 and V10, respectively. The D/A converter 74, like the D/A converter 58, is also comprised of an R-2R ladder resistor network and semiconductor switch ICs 140 and 142. Those switches are controlled by a magnification signal. The voltage generator 78 is comprised of a differential amplifier 144 of which the output terminal and the inverting input terminal are interconnected, a resistor 146, a potentiometer 148 and a resistor 150 connected in series between the output terminal of the D/A converter 74 and ground. A voltage dividing point of the potentiometer 148 is coupled with the noninverting input terminal of the differential amplifier 144, which produces an output voltage signal V15. The potentiometer 148 is used to reduce the difference in the voltage V15 between the apparatuses in the factory before shipment. A limiter 38 connected to the output of the voltage generator 78 is omitted in this figure.

Before proceeding with the description of the reference voltage generator of FIG. 3, the semiconductor switch IC will be described referring to FIG. 4. As shown, six switches are provided and which are corresponding to channels OX, 1X, OY, 1Y, OZ, and 1Z. Paired switches have a common connection at one ends. The terminals continuous to those common connection points of switch pairs are called an X-common terminal, a Y common terminal, and a Z common terminal, respectively. Control signals of those switches are denoted as A, B, C and INH. A relationship of the control signals and ON state of the channels is tabulated in the following table.

TABLE

| Control signal | | | | ON Channel | | |
|---|---|---|---|---|---|---|
| INH | C | B | A | | | |
| L | L | L | L | 0X, | 0Y, | 0Z |
| L | L | L | H | 1X, | 0Y, | 0Z |
| L | L | H | L | 0X, | 1Y, | 0Z |
| L | L | H | H | 1X, | 1Y, | 0Z |
| L | H | L | L | 0X, | 0Y, | 1Z |
| L | H | L | H | 1X, | 0Y, | 1Z |
| L | H | H | L | 0X, | 1Y, | 1Z |
| L | H | H | H | 1X, | 1Y, | 1Z |
| H | * | * | * | | NONE | |

*indicates both H and L.

Figure 3:
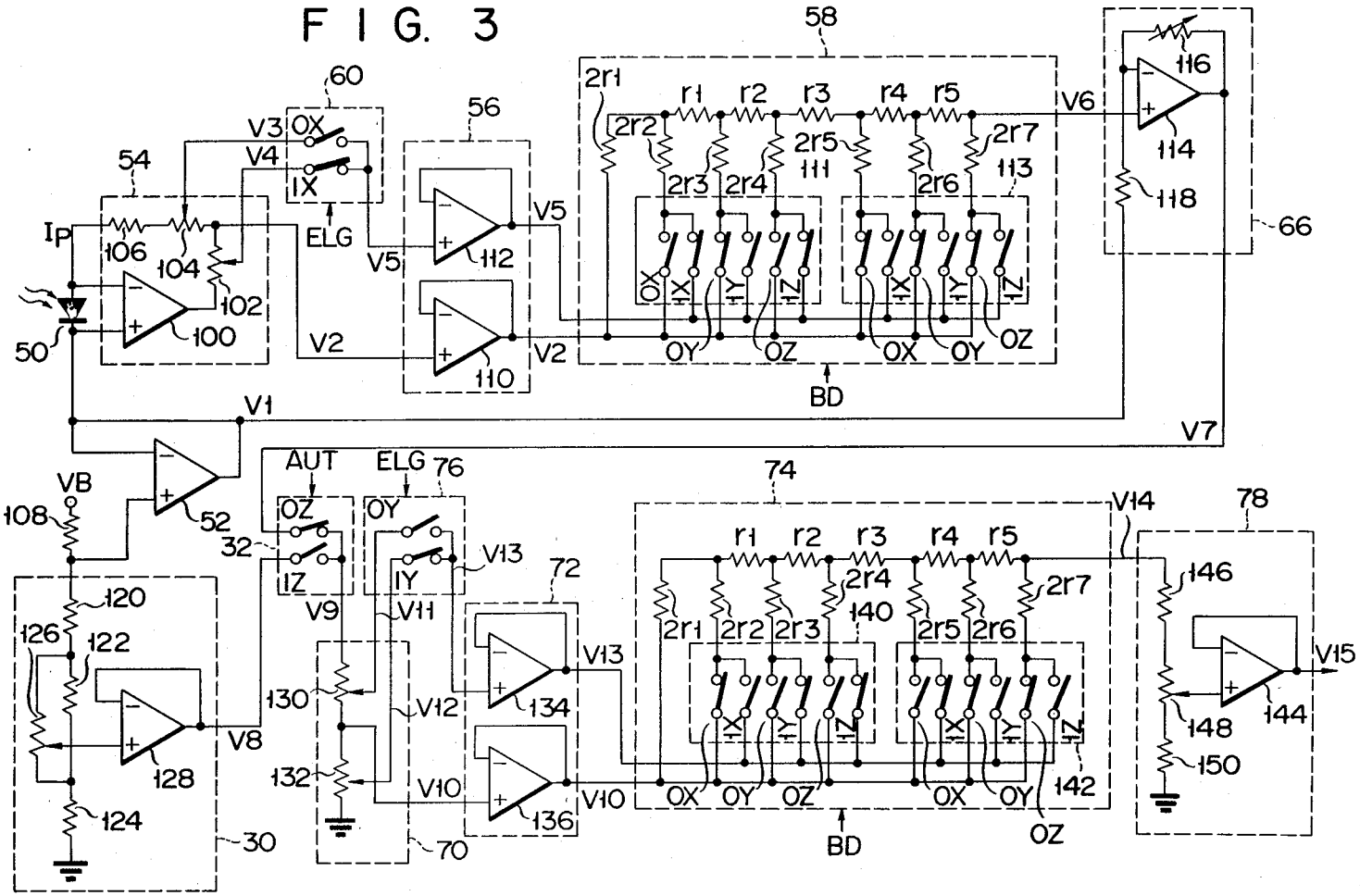
FIG. 3 is a circuit diagram of the control signal generator shown in FIG. 2.
Figure 4:
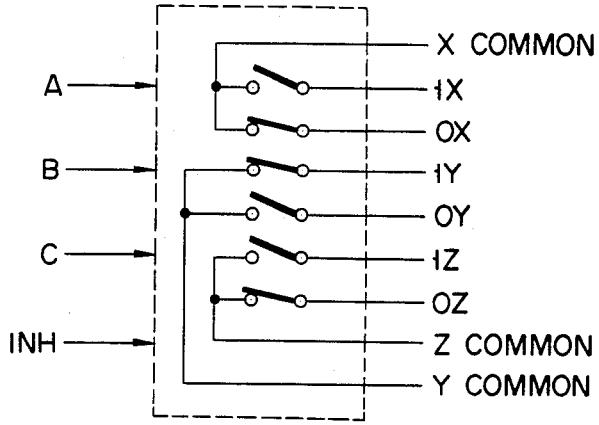
FIG. 4 is a schematic illustration of a semiconductor switch IC in the control signal generator shown in FIG. 3.
Figure 5:
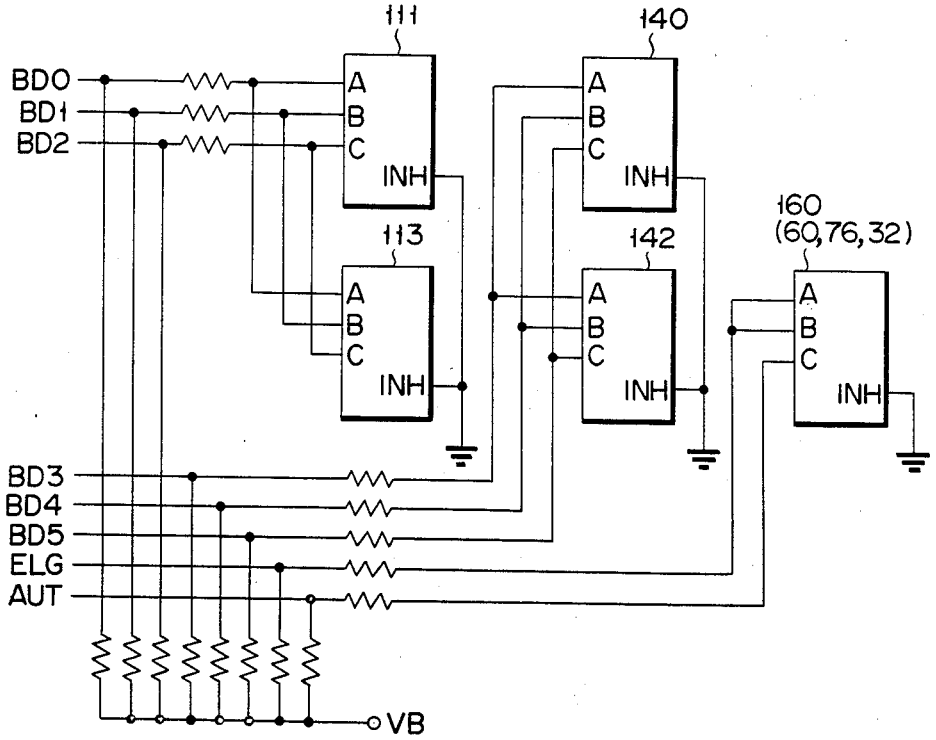
FIG. 5 is a schematic illustration of only the semiconductor switch ICs in FIG. 3, illustrated together with the control signals.

FIG. 5 shows only the semiconductor switch ICs in FIG. 3, together with the control signals associated therewith. The semiconductor switch IC 160 provides the selectors 32, 60 and 76. The signals read out from the ROM 45 are a 6-bit magnification signal BD0–BD5 (corresponding to the magnification signal Mg, and representing one of the integers 0–63, and 0 represents an equal magnification), a 1-bit enlargement signal (L in the enlargement (normal) mode), and a 1-bit automatic control signal AUT (L in an automatic copy density control mode). The magnification signals BD0–BD2 are respectively applied to the control terminals A, B and C of the semiconductor switch ICs 111 and 113. The magnification signals BD3–BD5 are respectively input to the control terminals A, B and C of the semiconductor switch ICs 140 and 142. The enlargement signal ELG is connected to the control terminal A (corresponding to the selector 60) and the control terminal B (selector 76) of the semiconductor switch IC 140. The automatic control signal AUT is input to the control terminal C (selector 32) of the semiconductor switch IC 160. The control terminal INH is grounded.

The operation of the FIG. 3 circuit will now be described. In the voltage generator 54, the voltage signals V2, V3 and V4 are given by:

$$V2 = V1 - (R1 + VR1)Ip \quad (15)$$

$$V3 = V1 - (R1 + VR1 - VR1')Ip \quad (16)$$

$$V4 = V1 - (R1 + VR1 + VR2')Ip \quad (17)$$

where R1 is the resistance of the resistor 106, VR1 is the resistance of the potentiometer 104, VR2 is the resistance of the potentiometer 102, VR1′ is the resistance between the voltage dividing point of the potentiometer 104 and the junction point of the potentiometers 104 and 102, and VR2′ is the resistance between the voltage dividing point of the potentiometer 102 and the junction of the potentiometers 104 and 102. In the above equations, (R1+VR1), (R1+VR1+VR1′), and (R1+VR1+VR2′) correspond respectively to the coefficients C1, C2 and C3 in the equations (1), (2) and (3). The voltage V2 is input through the buffer as the differential amplifier 110 to the channels OX, OY and OZ of the semiconductor switch ICs 111 and 113. Either of the voltages V3 and V4 is selected by the selector 60 controlled by the enlargement signal ELG and is input to the channels 1X, 1Y and 1Z of the switch ICs 111 and 113 through the buffer as the differential amplifier 112. The enlargement signal ELG is L in the enlargement (normal) mode and H in the reduction mode. Therefore, in the selector 60, the OX channel is turned on and the voltage V3 is selected in the enlargement (normal) mode. In the reduction mode, the 1X channel is turned on and the voltage V4 is selected.

In the D/A converter 58, the control signals to the channels connected to the resistors 2r2–2r7 are BD0(LSB)–BD5(MSB), respectively, as shown in FIG. 5. The output V6 of the D/A converter 58 is given as:

$$V6=V2+(BD0+2BD1+4BD2+8BD3+16BD4+32BD5)(V5-V2)/64 \quad (18)$$

V5 takes the value of V4 in the enlargement (normal) mode and the value of V3 in the reduction mode. Further, the signals BD0–BD5 are each 0 or 1. (BD0+2BD1+4BD2+8BD3+16BD4+32BD5)/64 in the equation (18) indicates the magnification signal obtained when the binary magnification signal is converted into a decimal one. Then, if this signal is the signal Mg (any one of 0–63), the equation (18) is equal to equation (4). Substituting the equations (15), (16) and (17) into the equation (18):

$$V6=V1-(R1+VR1-MgVR1')Ip \quad (19)$$

(for the enlargement (nomral) mode)

$$V6=V1-(R1+VR1+MgVR2')Ip \quad (20)$$

(for the reduction mode)

In the voltage generator 66, if resistance of the variable resistor 116 is VR3 and resistance of the resistor 118 is R2, the coefficient C2 in the equation (5) is (1+VR3/R2). As a result, the output signal of the voltage generator 66 the output signal V7 of the automatic copy density controller 28 is given by;

$$V7=V1-(1+VR3/R2)(R1+VR1-MgVR1')Ip \quad (21)$$

(for the enlargement (normal) mode)

$$V7=V1-(1+VR3/R2)(R1+VR1+MgVR2')Ip \quad (22)$$

Figure 6:
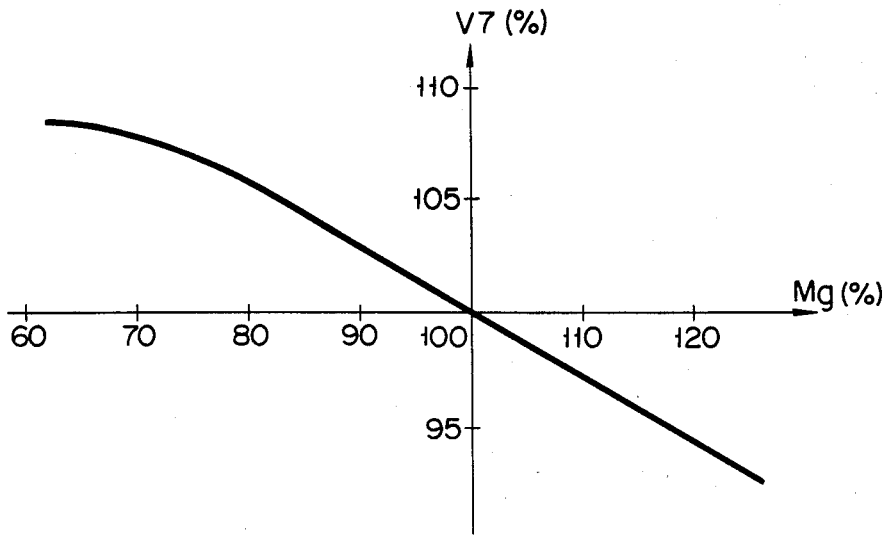
FIG. 6 is a graphic representation of an output characteristic of an automatic copy density controller in the control signal generator of FIG. 3.

(for the reduction mode)

where resistors R1, R2 and VR1 are constant, and VR1', VR2', VR3 and Mg are variable. In the equations (6) and (7), the coefficients capable of adjusting the output voltage signal V7 of the automatic copy density controller 28 are C2, C3 and C4. To control the copy density irrespective of the copy magnification, it is preferable that the output voltage V7 of the automatic copy density controller varies against the magnification, as shown in FIG. 6. This is realized by making the data of the magnification signal BD0–BD5 correspond to the magnification in a one to one correspondence, so that the output voltage V7 of the automatic copy density controller 28 varies against the magnification, as shown in FIG. 6. Actually, however, the relation differs for each copy machine and frequently deviates from this characteristic of FIG. 6. Such deviation can be solved by adjusting the variable resistor VR3 for the normal mode (Mg=0), adjusting the resistor VR1' for the enlargement mode, and adjusting the resistor VR2' for the reduction mode. By changing the data of the magnification signal BD0–BD5 against the magnification Mg (%), the characteristic of the output signal V7 of the automatic copy density controller 28 may be changed properly. Either the voltage V7 produced from the automatic copy density controller 28 or the voltage V8 produced from the manual copy density controller 30 is selected by the selector 32. The selector 32 corresponds to the C channel of the semiconductor switch IC 160.

As shown in FIG. 5, when the automatic control signal AUT is L, the output V7 of the automatic copy density controller 28 is selected. In the voltage generator 70, the output voltages V10, V11 and V12 are given by $$V10=\{VR5/(VR4+VR5)\}V9 \quad (23)$$

$$V11=\{(VR4'+VR5)/(VR4+VR5)\}V9 \quad (24)$$

$$V12=\{(VR5-VR5')/(VR4+VR5)\}V9 \quad (25)$$

where the resistances of the potentiometers 130 and 132 are VR4 and VR5, and resistances between the junction point of the potentiometers 130 and 132 and the voltage dividing points of the potentiometers 130 and 132 are VR4' and VR5'. In the above equations, VR5/(VR4+VR5), (VR4'+VR5)/(VR4+VR5), and (VR5−VR5')/(VR4+VR5) are the coefficients C5, C6 and C7 in the equations (8), (9) and (10), respectively.

Since the selector 76, like the selector 60, is controlled by an enlargement signal ELG, it produces the voltage signal V11 as the voltage signal V13 in the enlargement (normal) mode, and produces the voltage signal V12 as the voltage signal V13 in the reduction mode.

The D/A converter 74, like the D/A converter 58, produces the following voltage V14:

$$V14=V10+(BD0+2BD1+4BD2+8BD3+16BD4+32BD5)/64 \quad (26)$$

Putting (BD0+2BD1+4BD2+8BD3+16BD4+32BD5)/64 as Mg, and substituting the equations (23), (24), and (25) into the equation (26), the equation (26) can be rewritten as:

$$V14=\{(VR5+MgVR4')V9\}/(VR4+VR5) \quad (27)$$

(for the enlargement (normal) mode)

$$V14=\{(VR5-MgVR5')V9\}/(VR4+VR5) \quad (28)$$

(for the reduction mode)

Assuming that, in the voltage generator 78, the resistance of the potentiometer 148 is VR6, the resistance between a voltage dividing point of the potentiometer 148 and a junction point between the potentiometer 148 and the resistor 150 is VR6', the resistances of the resistors 146 and 150 is R3 and R4, the output impedance of the D/A converter 74 is R, then the coefficient C8 in the equation (12) is (VR6'+R4)/(VR6+R3+R4+R). Hence, the output signal of the voltage generator 78, (the control signal output from the control signal generator 40) is given as:

$$V15=\{(VR5+MgVR4')(VR6'+R4)V9\}/\{(VR4+VR5)(VR6+R3+R4+R)\} \quad (29)$$

(for the enlargement (normal) mode)

$$V15=\{(VR5-MgVR5')(VR6'+R)V9\}/\{(VR4+VR5)(VR6+R3+R4+R)\} \quad (30)$$

Figure 7:
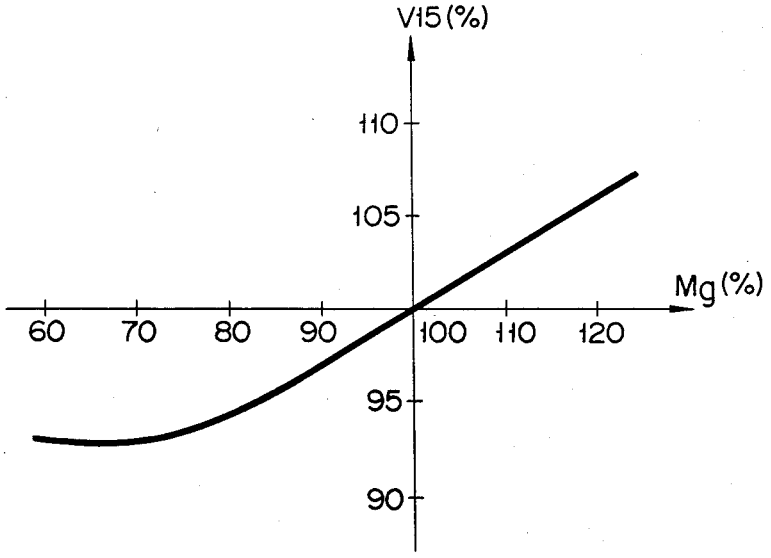
FIG. 7 is a graphic representation of an output characteristic of the control signal generator of FIG. 3.

(for the reduction mode)

where resistances R, R3, R4, VR6 are constant, and resistances VR4, VR5 and VR6' and magnification Mg are variable. By relating the data of the magnification signal to a magnification in a one-to-one correspondence so that the output voltage V15 of the total adjusting circuit 26 varies with respect to the magnification as shown in FIG. 7, the control signal V15 output from the control signal generator 40 varies with respect to the magnification, as shown in FIG. 7. The variation of the control signal V15, as shown in FIG. 7, allows the density of the copy to be independent of the magnification. Actually, this value varies with the copy machines used and frequently deviates from the characteristic curve shown in FIG. 7. Such deviation can easily be removed by adjusting the resistance VR6' for the normal mode (Mg=0), the resistance VR4' for the enlargement mode, and the resistance VR5' for the reduction mode. In an actual copy machine, the magnification is set in terms of % printed on the operation panel 44 associated with a lever or knob. The magnification data BD0–BD5 are previously stored in the ROM 45 and are read out when needed.

As described above, in the above-mentioned embodiment, the voltage applied to the exposure lamp 12 is controlled according to the output signal from the D/A converter, as applied with the magnification data, thereby guaranteering a constant, optimum exposure of the document. As a result, a continuous change of the magnification is realized. Further, the copy density is made independent of the magnification. A variation of the characteristics of the copy machines can easily be corrected.

Figure 8:
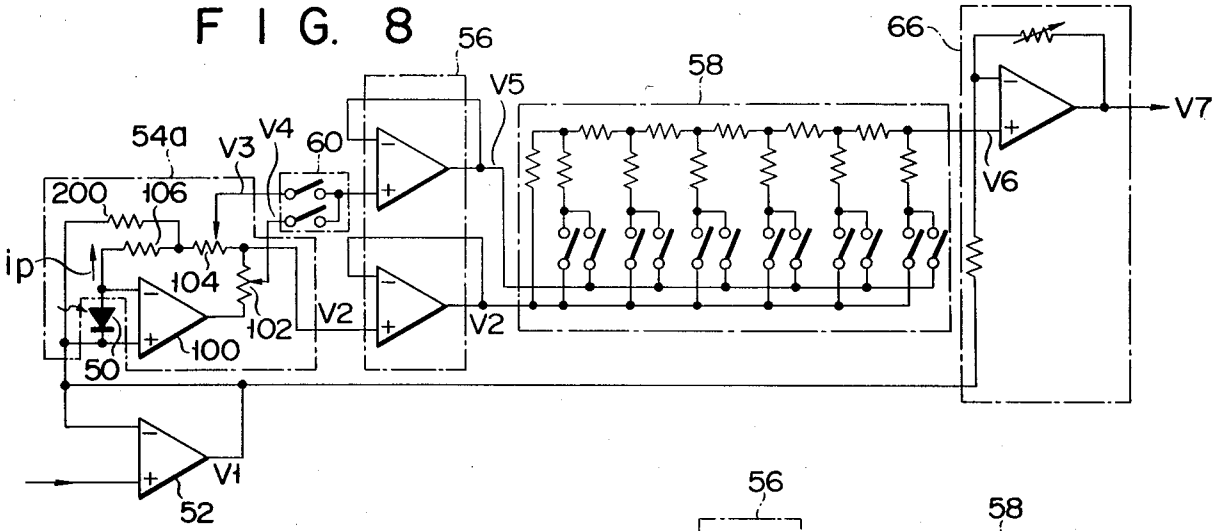
FIGS. 8 through 14 are first to seventh modifications of the automatic copy density controller shown in FIG. 3.

It should be understood that the present invention may be changed and modified variously within the scope of the invention. As an example, in the automatic copy density controller 28 and the total adjusting circuit 26, it is possible to change the location of the variable resistor for adjusting the characteristic of the copy machine, which may actually vary among the products of the copy machines. As seen from the equations (6) and (7), the output voltage V7 of the automatic copy density controller 28 is adjustable by using the coefficients C1–C3 associated with the voltage generator 54 and the coefficient C4 associated with the voltage generator 66. In the above-mentioned embodiment, the coefficient C1 is fixed. The first to seventh modifications of the automatic copy density controller 28, which are based on different ways of making adjustments, will be described referring to FIGS. 8–14. In the first modification of FIG. 8, C1 is fixed and C4≧1. Further, a voltage generator 54a is provided instead of the voltage generator 54 in the FIG. 3 circuit. In a voltage generator 54a, a resistor 200 is additionally provided between the differential amplifier 100 and a junction point of the resistor 106 and the variable resistor 104. Assuming that the resistance of the resistor 200 is R200 (the resistance of the remaining resistors are equal to those as mentioned above), the output voltage signals V2, V3 and V4 of the voltage generator 54 are:

$$V2=V1-\{R1+(1+R1/R200)VR1\}Ip \quad (31)$$

$$V3=V1-\{R1+(1+R1/R200)(VR1-VR1')\}Ip \quad (32)$$

$$V4=V1-\{R1+(1+R1/R200)(VR1+VR2')\}Ip \quad (33)$$

Therefore, the output voltage of the buffer 56 is given as:

$$V7=V1-\{R1+(1+R1/R200)VR1 -(1+R1/R200)VR1'Mg\}(1+VR3/R2)Ip \quad (34)$$

(for the enlargement (normal) mode)

$$V7=V1-\{R1+(1+R1/R200)VR1 +(1+R1/R200)VR2'Mg\}(1+VR3/R2)Ip \quad (35)$$

(for the reduction mode)

where, of those coefficients, the resistances R200, R1, R2, VR1 and VR2 are constant and the resistances VR1', VR2' and VR3 are variable. The resistance VR3 is used for the adjustment of the normal mode, the resistance VR1' is used for the adjustment of the enlargement mode, and resistance VR2' is used for the adjustment of the reduction mode. Through the adjustment, the output voltage V7 of the voltage generator 66 is controlled as shown in FIG. 6.

Figure 9:
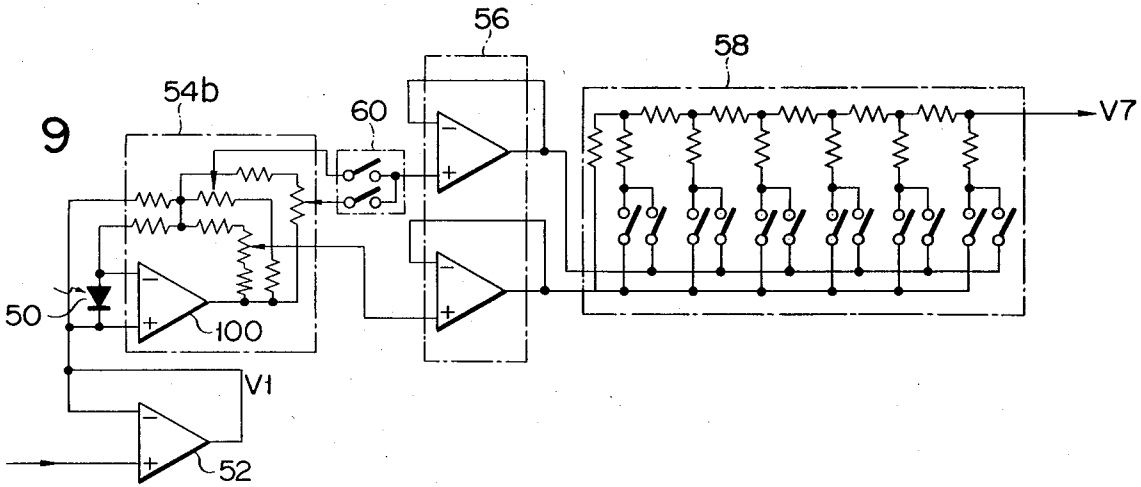

FIG. 9 shows the second modification in which C4=1. In this modification, the voltage generator 66 in the FIG. 8 circuit is omitted, and the voltage generator 54a is replaced by a voltage generator 54b.

Figure 10:
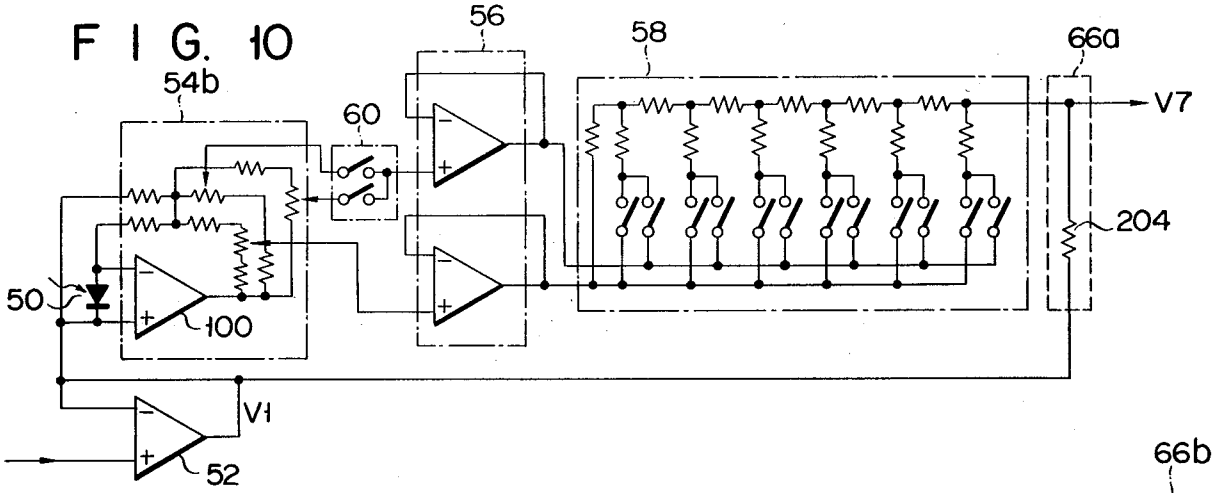

FIG. 10 shows a third modification where C1 is smaller than 1. The reference voltage V1 is applied to the output terminal of the D/A converter 58, through a voltage generator 66a formed of a resistor 204 in the circuit arrangement of FIG. 9.

Figure 11:
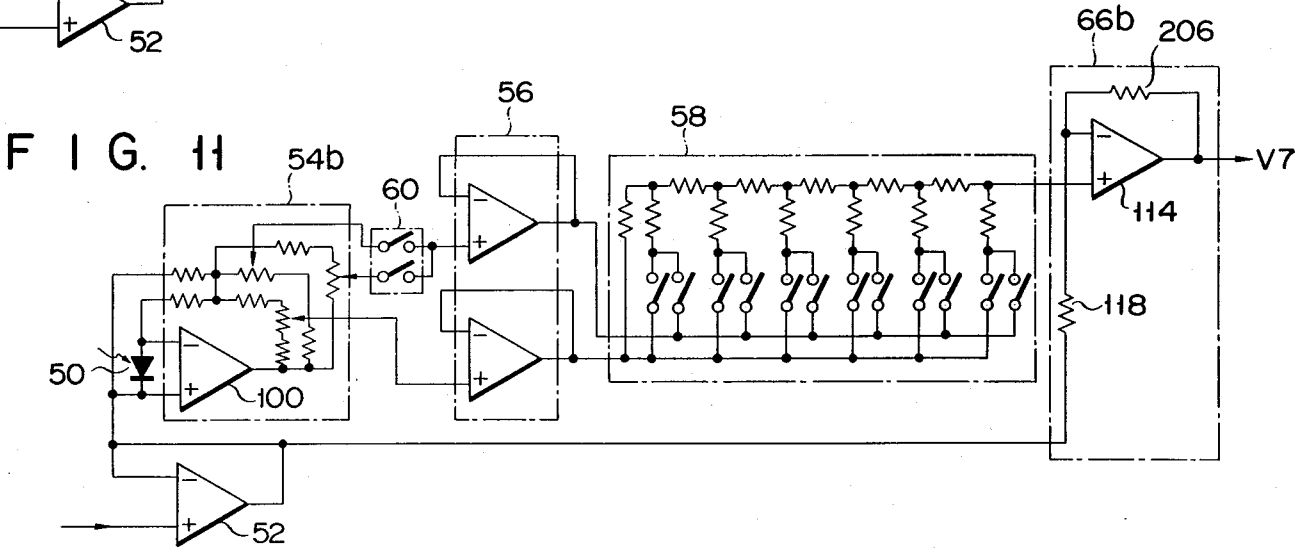

FIG. 11 shows the fourth embodiment where the coefficient C1 is large than 1. In this circuit, the voltage generator 66a in the FIG. 10 embodiment is replaced by a voltage generator 66b. The voltage generator 66b is equivalent to the voltage generator 66 of FIG. 3 of which the variable resistor 116 is replaced by a resistor 206.

Figure 12:
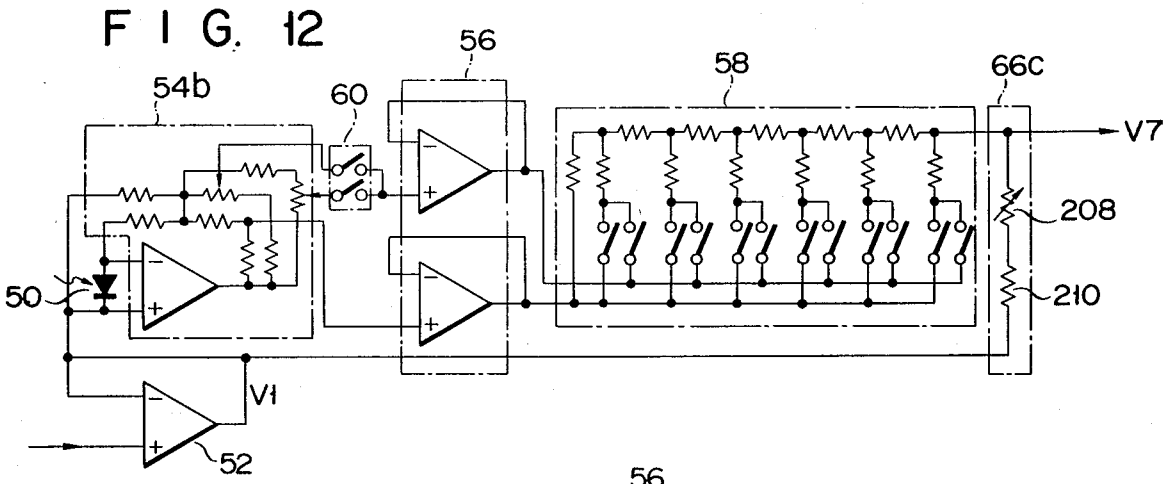

FIG. 12 shows the fifth modification in which the coefficient C1 is smaller than 1. The voltage generator 66b in the fourth modification of FIG. 11 is replaced by a voltage generator 66c formed of a series circuit of a variable resistor 208 and a resistor 220.

Figure 13:
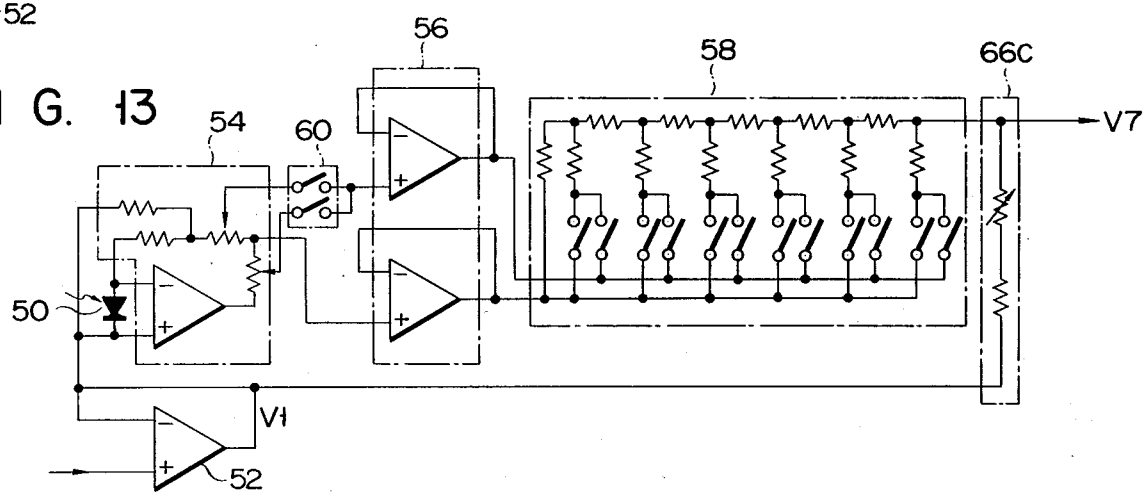

FIG. 13 shows the sixth modification in which the coefficient C1 is smaller than 1. The voltage generator 54 in FIG. 3 is used for the voltage generator 54b in the fourth modification of FIG. 12.

Figure 14:
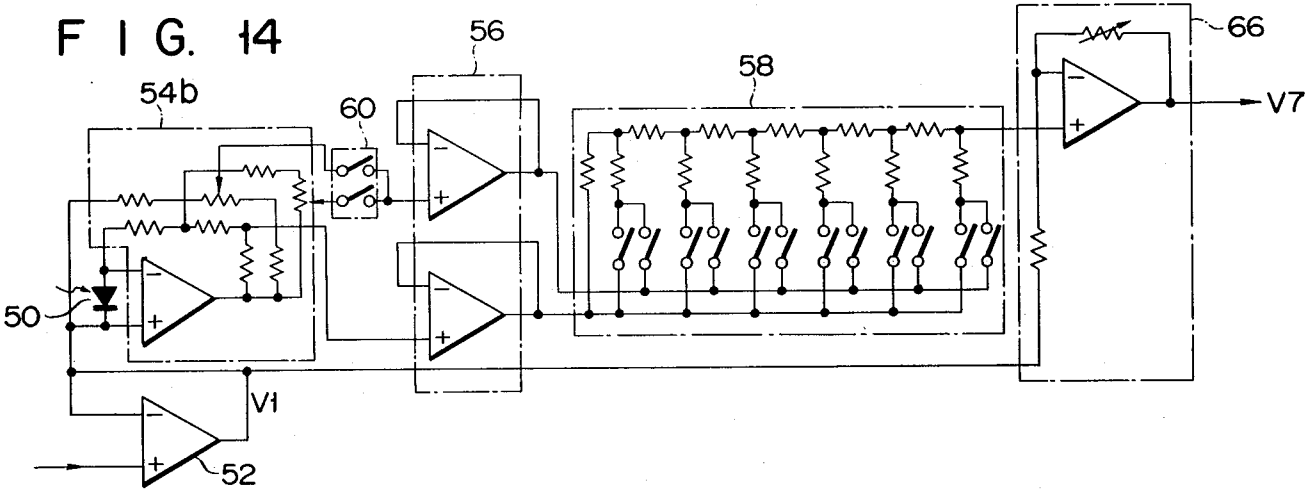

FIG. 14 shows the seventh modification in which the coefficient C1 is smaller than 1. The voltage generator 66 in FIG. 3 is used for the voltage generator 66c in the fourth modification of FIG. 12.

The equations (13) and (14) show that the output voltage V15 of the total adjusting circuit 26 can be adjusted by using the coefficients C5–C7 of the voltage generator 70 and the coefficient C8 of the voltage generator and 78. Modifications of the total adjusting circuit 26 based on this will be described referring to FIGS. 15 to 26.

Figure 15:
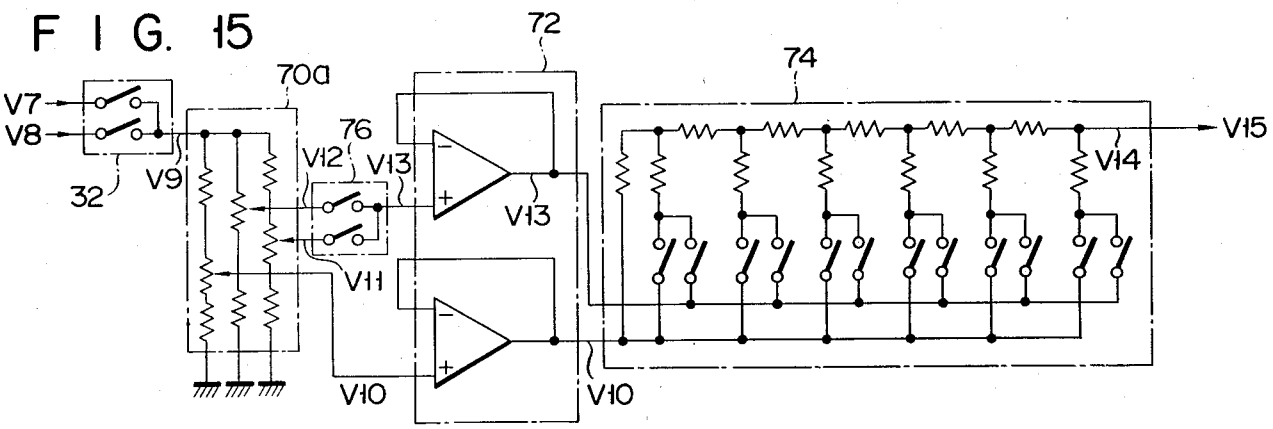
FIGS. 15 through 26 are circuit diagrams of first to twelfth modifications of a total adjusting circuit used in the control signal generator shown in FIG. 3.

FIG. 15 shows a first modification in which the voltage generator 70 is replaced by a voltage generator 70a and the voltage generator 78 is omitted in the arrangement of FIG. 3.

Figure 16:
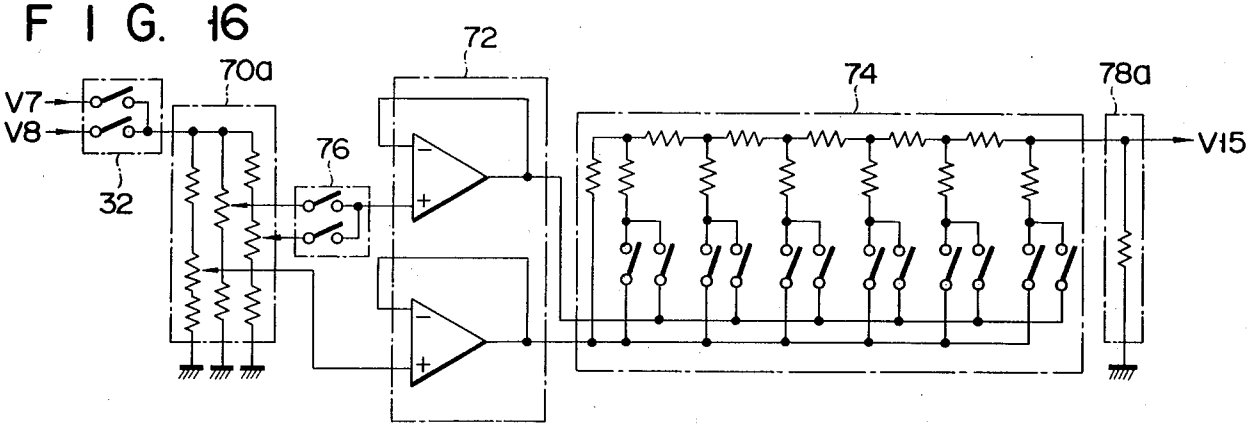

FIG. 16 shows a second modification in which a voltage generator 78a is additionally used in the FIG. 15 circuit.

Figure 17:
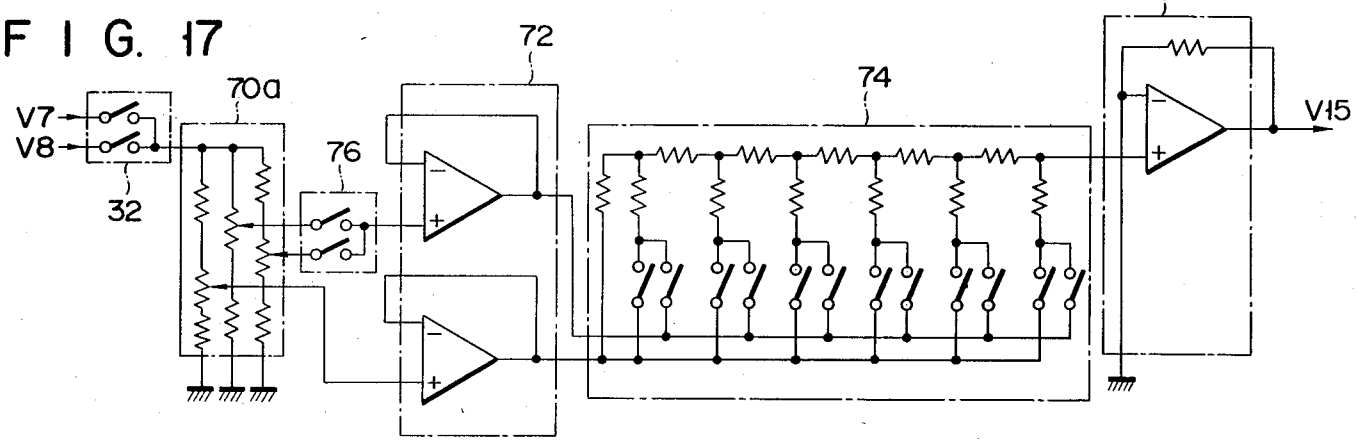

FIG. 17 shows a third modification in which the voltage generator 78a in the FIG. 16 circuit is replaced by a voltage generator 78b.

Figure 18:
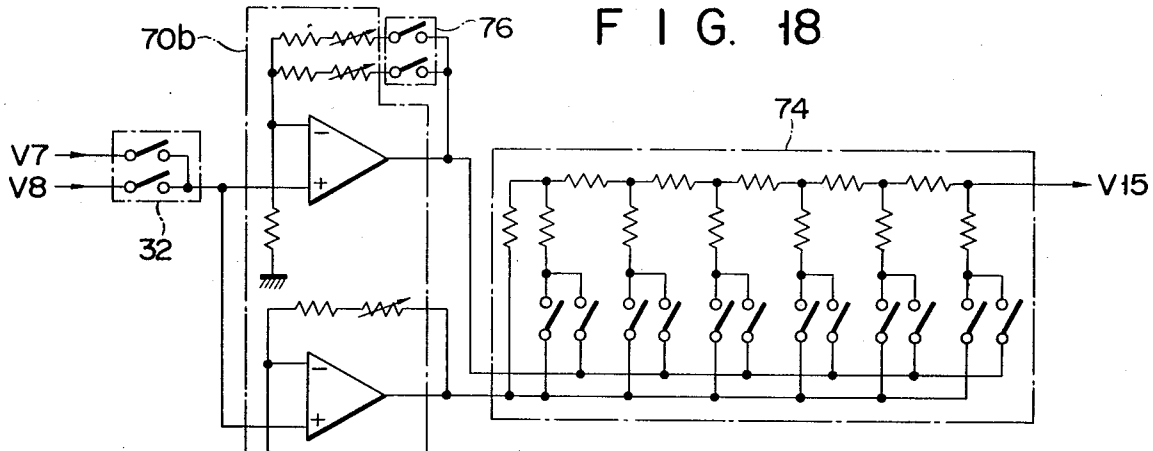

FIG. 18 shows a fourth modification where the voltage generator 78b is omitted and the voltage generator 70a and the buffer 72 are combined together to form a voltage generator 70b in the FIG. 17 circuit.

Figure 19:
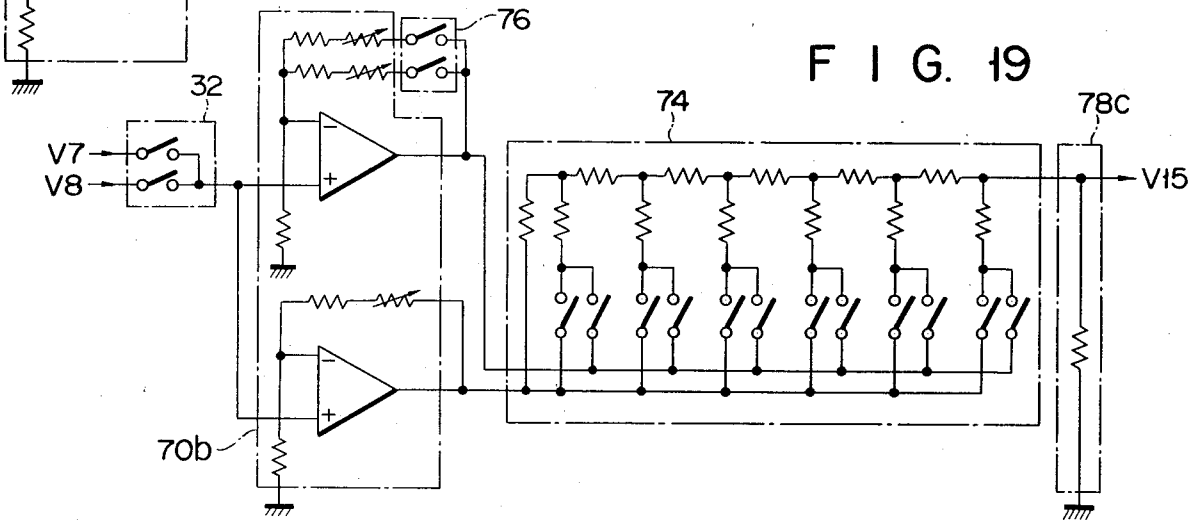

FIG. 19 shows a fifth modification where a voltage generator 78c is additionally used for the circuit of FIG. 18.

Figure 20:
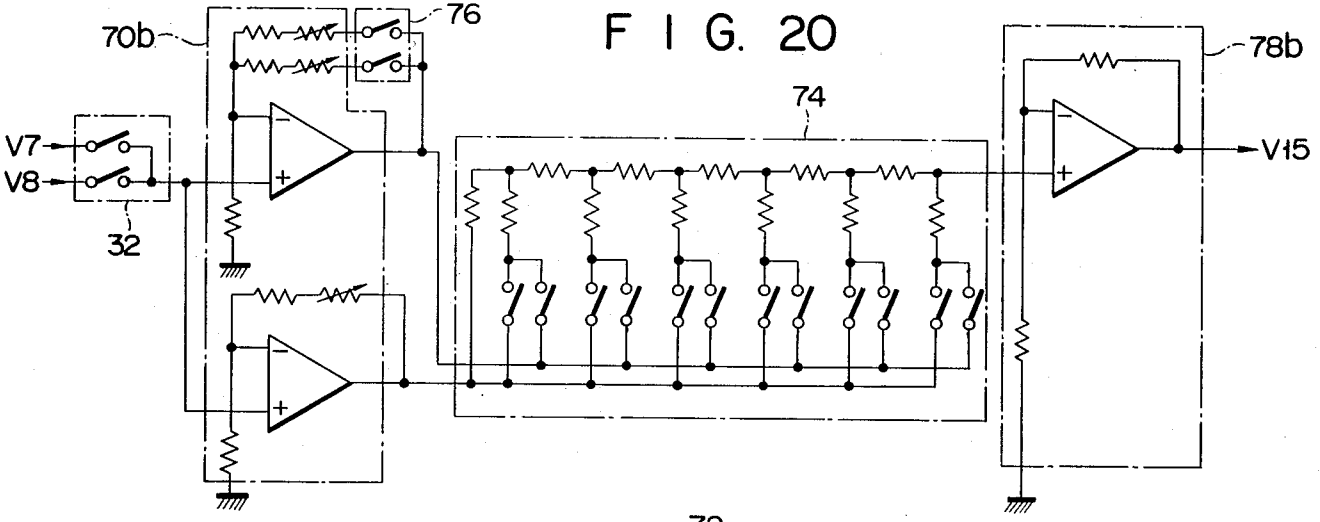

FIG. 20 shows a sixth modification where the voltage generator 78*b* in the third embodiment of FIG. 17 is used for the voltage generator 78*c* in the FIG. 19 circuit.

Figure 21:
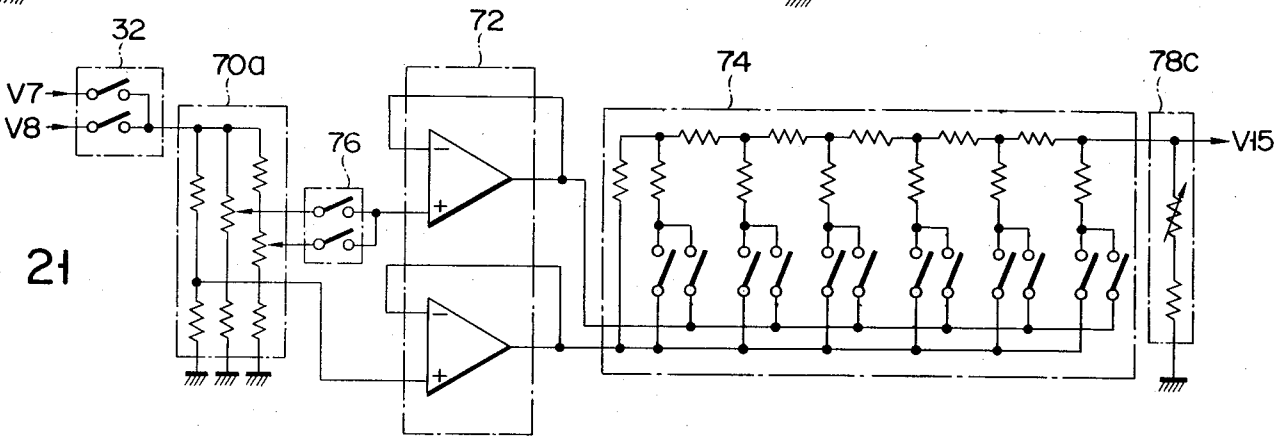

FIG. 21 shows a seventh modification in which the voltage generator 70*c* in the FIG. 15 circuit is used as the voltage generator 70*b* in the FIG. 20 circuit, and the voltage generator 78*b* is replaced by the voltage generator 78*c* shown in FIG. 19.

Figure 22:
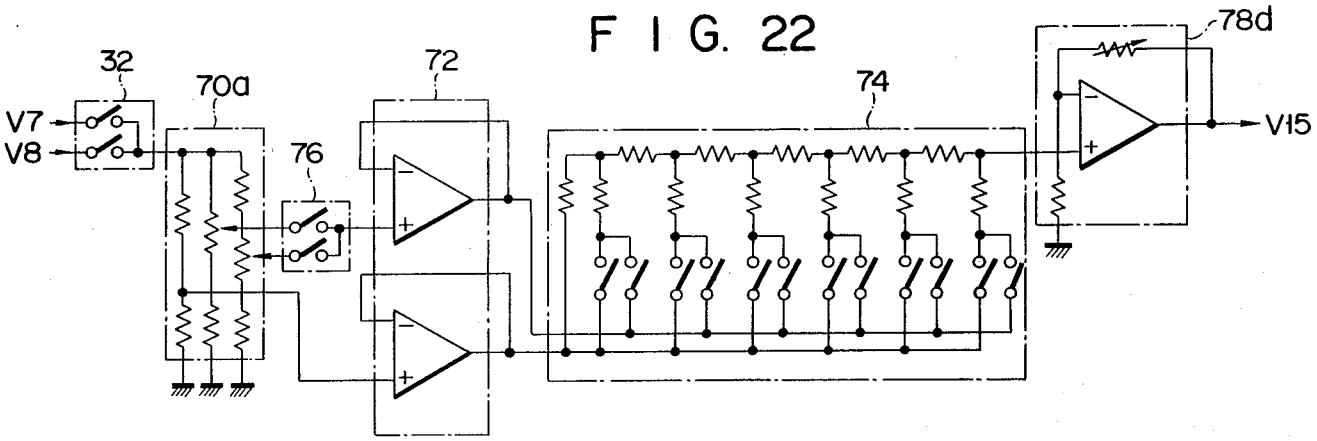

FIG. 22 shows an eighth modification in which the voltage generator 78*c* in the FIG. 21 circuit is replaced by a voltage generator 78*d*.

Figure 23:
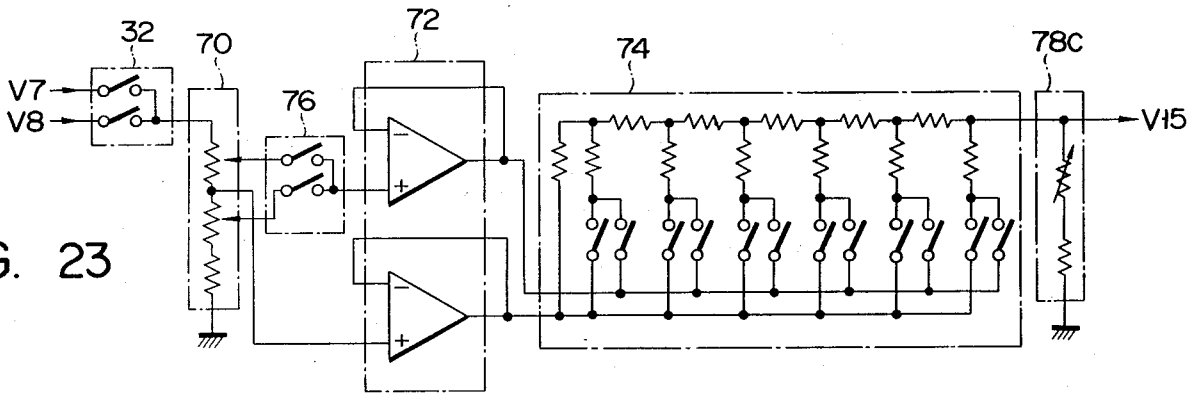

FIG. 23 shows a ninth modification where the voltage generator 78*d* in the FIG. 22 circuit is replaced by the voltage generator 78*c* of FIG. 21 and the voltage generator 70*a* is replaced by the voltage generator 70 in the FIG. 3 circuit.

Figure 24:
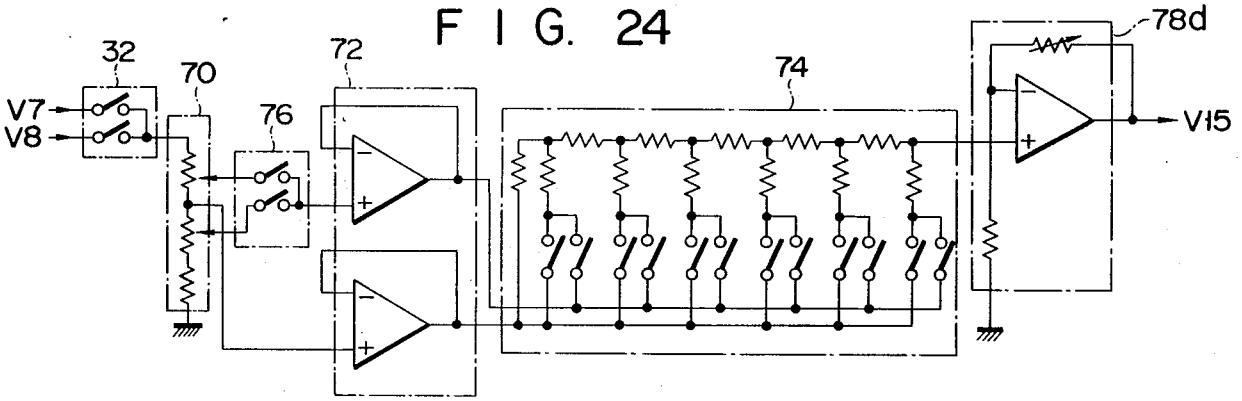

FIG. 24 shows a tenth modification where the voltage generator 78*c* in the FIG. 23 circuit is replaced by the voltage generator 78*d* in the FIG. 22 circuit.

Figure 25:
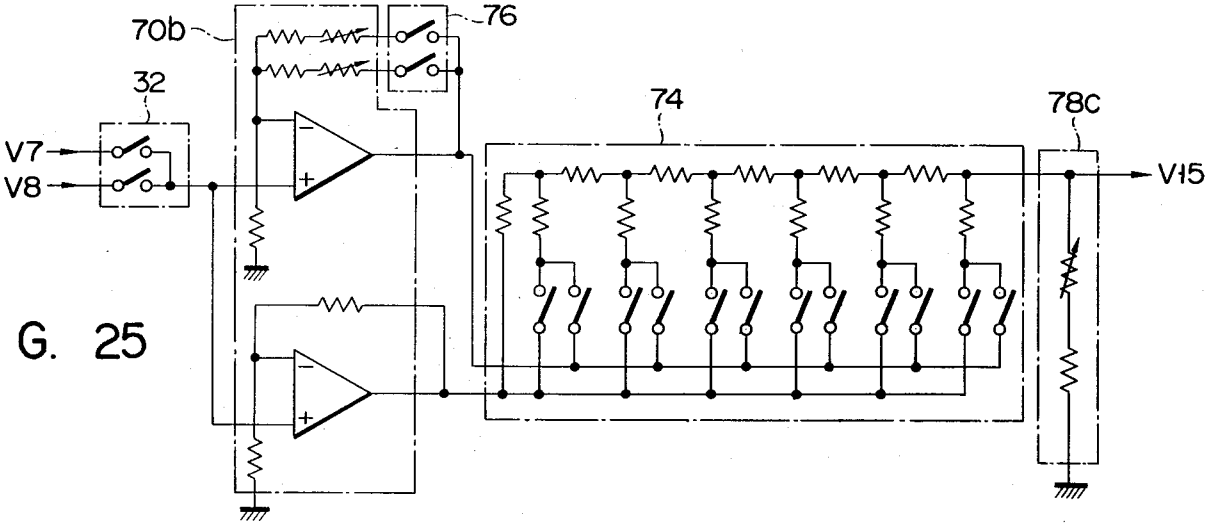

FIG. 25 is an eleventh modification where the voltage generator 78*d* in the FIG. 24 circuit is replaced by the voltage generator 78*c* in the FIG. 21 circuit, and further the voltage generator 70 is substituted by the voltage generator 70*s* in the FIG. 19 circuit.

Figure 26:
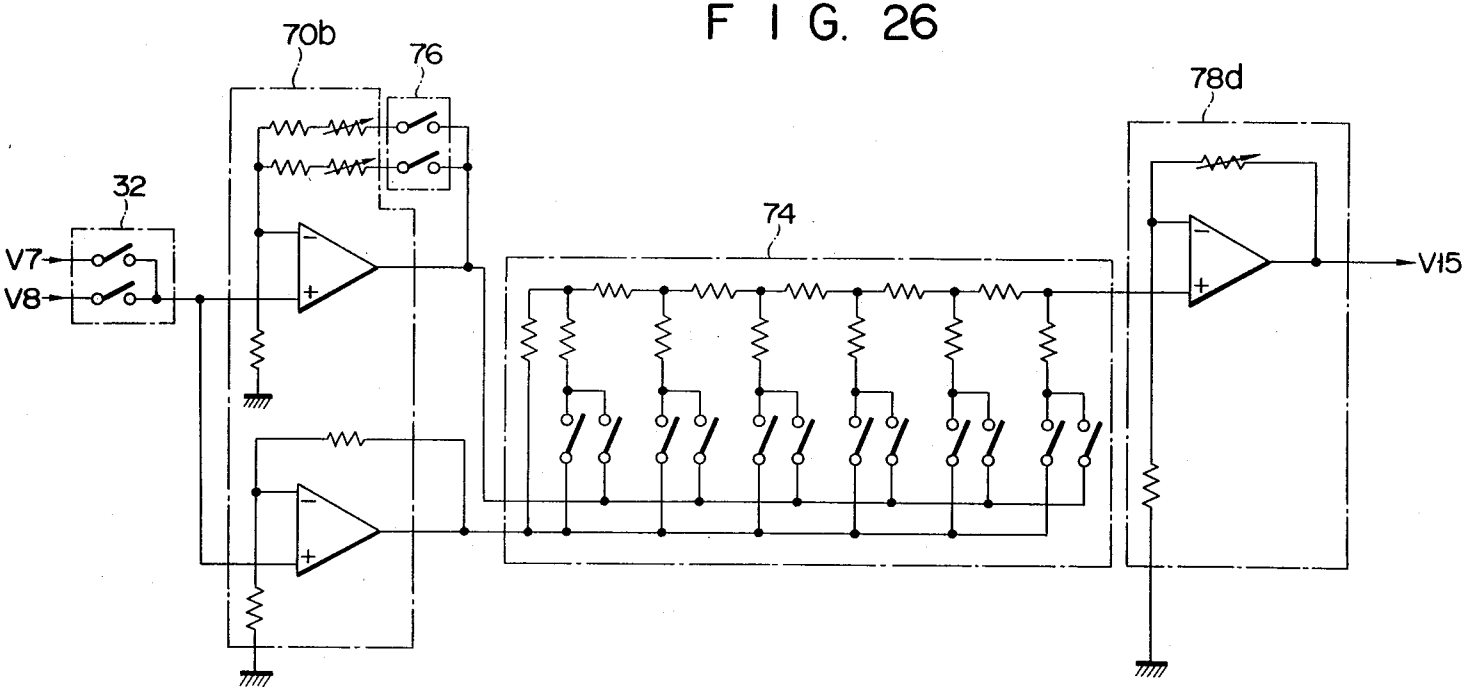

FIG. 26 is a twelfth modification in which the voltage generator 78*d* in the FIG. 22 circuit is substituted for the voltage generator 78*c* in the FIG. 25 circuit.

In the above-mentioned embodiment, the voltage selected depending on the type of the magnification, enlargement or reduction, is used as the power voltage for the D/A converter. The D/A converters may be provided for the enlargement and the reduction, and the output signals of these converters are selectively used according to the type of the magnification. The continuous change of the magnification may be replaced by some specific magnifications. The ladder type resistor network in the D/A converter may be replaced by the weighting reistor network or the resistor dividing type network.

As seen from the foregoing description, the D/A converter is used for generating the control voltage in the exposure control circuit to determine an amount of exposure light. Therefore, the control voltage may easily be made correspond to the magnification by merely inputting the magnification signal (digital signal) into the D/A converter in the exposure control circuit. This feature provides an optimum exposure of the document for any magnification.

What is claimed is:

1. An image forming apparatus comprising:

lamp means for exposing a document;

magnification setting means for generating a magnification signal;

means, connected to said magnification setting means, for forming an image of the document on a recording medium based on a light from the exposed document, a size of the image being determined by the magnification signal;

memory means, connected to said magnification setting means, which stores digital data corresponding to various magnifications and produces the digital data in response to the magnification signal; and lamp control means, connected to said lamp means and memory means, for applying a power voltage to said lamp means in accordance with the digital data generated from said memory means.

2. An apparatus according to claim 1, wherein said magnification setting means selects any one of the continuously differring magnifications, and the magnification signal corresponds to a set magnification in a one-to-one correspondence.

3. An apparatus according to claim 1, wherein said lamp control means comprises a D/A converter for generating an analog voltage signal corresponding to the digital data.

4. An apparatus according to claim 1, wherein said lamp control means comprises a limiter connected at the output terminal thereof to prevent that the power voltage is over the rating of said lamp means.

5. An image forming apparatus comprising:

lamp means for exposing a document;

magnification setting means for generating a magnification signal;

detecting means for detecting a density of the document based on a light from the exposed document and for producing a density voltage corresponding to the detected density;

means, connected to said magnification setting means, for forming an image of the document on a recording medium based on a light from the exposed document, a size of the image being determined by the magnification signal;

memory means, connected to said magnification setting means, which stores digital data corresponding to various magnifications and produces the digital data in response to the magnification signal; and lamp control means, connected to said detecting means, lamp means and memory means, for applying a power voltage to said lamp means in accordance with the density voltage and the digital data generated from said memory means.

6. An apparatus according to claim 5, wherein said magnification setting means selects any one of the continuously differring magnifications, and the magnification signal corresponds to a set magnification in a one-to-one correspondence.

7. An apparatus according to claim 5, wherein said lamp control means comprises a D/A converter for generating an analog voltage signal corresponding to the digital data.

8. An apparatus according to claim 5, wherein said lamp control means comprises a limiter connected at the output terminal thereof to prevent that the power voltage is over the rating of said lamp means.

* * * * *